United States Patent [19]

Yoshino et al.

[11] Patent Number: 4,655,878

[45] Date of Patent: Apr. 7, 1987

[54] METHOD OF REGULATING FUEL SUPPLY RATE FOR HEATING A COKE OVEN

[75] Inventors: Yoshio Yoshino; Koji Tsuchihashi; Yoshihiro Omae; Kenzo Tsujikawa; Takashi Takaoka, all of Kita-Kyushu; Yukio Yamaguchi, Kawasaki, all of Japan

[73] Assignee: Mitsubishi Chemical Industries, Ltd., Tokyo, Japan

[21] Appl. No.: 668,930

[22] Filed: Nov. 7, 1984

[30] Foreign Application Priority Data

| | | | |
|---|---|---|---|
| Nov. 7, 1983 | [JP] | Japan | 58-208869 |
| Nov. 7, 1983 | [JP] | Japan | 58-208870 |
| Nov. 7, 1983 | [JP] | Japan | 58-208871 |
| Nov. 7, 1983 | [JP] | Japan | 58-208872 |
| Nov. 7, 1983 | [JP] | Japan | 58-208873 |
| Nov. 7, 1983 | [JP] | Japan | 58-208874 |
| Feb. 14, 1984 | [JP] | Japan | 59-25641 |

[51] Int. Cl.[4] ..... C10B 21/10; C10B 21/20

[52] U.S. Cl. ..... 201/1; 201/41; 436/55

[58] Field of Search ..... 201/1, 41; 202/270, 202/151; 422/62; 436/55

[56] References Cited

U.S. PATENT DOCUMENTS

| | | | |
|---|---|---|---|
| 4,421,604 | 12/1983 | Weskamp et al. | 201/1 |

FOREIGN PATENT DOCUMENTS

| | | | |
|---|---|---|---|
| 893431 | 10/1982 | Belgium | 201/1 |
| 1444343 | 12/1968 | Fed. Rep. of Germany | 201/1 |
| 159877 | 10/1982 | Japan | 201/1 |
| 142973 | 8/1983 | Japan | 201/1 |
| 7212547 | 3/1973 | Netherlands | 201/1 |
| 834104 | 5/1981 | U.S.S.R. | 201/1 |
| 844624 | 7/1981 | U.S.S.R. | 201/1 |

*Primary Examiner*—Arnold Turk
*Assistant Examiner*—Joye L. Woodard
*Attorney, Agent, or Firm*—Oblon, Fisher, Spivak, McClelland & Maier

[57] ABSTRACT

A method of regulating fuel for a coke oven by a programmed heating method in which a change of the fuel supply rate contains at least one substantial reduction during the coal carbonization process in the coke oven, wherein the improvement comprises setting up a standard curve for the ethylene concentration or the tar concentration based on the operating conditions of the coke oven and the conditions of feed coal, measuring the ethylene concentration or the tar concentration in the coke oven gas generated in the carbonization chamber, and controlling the fuel supply rate so as to minimize the difference between the measured value and the standard value.

9 Claims, 14 Drawing Figures

OVEN TEMP. (°C)
1200
1100
GAS COMPOSITION (%)
(ETHYLENE)
10
9
8
7
6
5
4
3
2
1
0
FUEL SUPPLY RATE (%)
150
100
50
CARBONIZATION TIME (HR)
0 1 2 3 4 5 6 7 8 9 10 11 12 13 14 15 16
FIRE EXTINCTION
9
10
11
10

METHOD OF REGULATING FUEL SUPPLY RATE FOR HEATING A COKE OVEN

FIELD OF THE INVENTION

The present invention relates to a method of regulating fuel for a coke oven. More particularly, the present invention relates to a method of regulating fuel for a coke oven by a programmed heating method in which a change of the fuel supply rate contains at least one substantial reduction during the coal carbonization process.

DESCRIPTION OF THE PRIOR ART

The fuel regulate of a coke oven is intended basically to regulate the oven temperature, and has been carried out by regulating the fuel supply rate to maintain the oven temperature at a level predetermined on the basis of the operating conditions.

As an energy saving measure for a coke oven, a so-called programmed heating method has been proposed wherein the supply rate of fuel to the coke oven is set to be a large flow rate at the initial stage of the carbonization and then adjusted to a proper supply rate depending upon the particular purpose of each of the subsequent stages. Namely, in this method, the fuel supply rate is maintained at a level of from 1.6 to 2.5 times the supply rate of a regular heating method, up to 3 to 9 hours after the initiation of carbonization, and then switched, 1 to 3 times, to a small flow rate inclusive of a zero rate.

However, every conventional programmed heating method has a drawback that the regulating is practically difficult because the heating pattern is complicated in the operation of the presently available coke oven, or specific standards for the heating pattern are not established or no adequate consideration is given to the quality aspect of the coke product.

SUMMARY OF THE INVENTION

Under these circumstances, the present inventors have conducted extensive researches to solve the above-mentioned problems, and have found that the after mentioned heat regulating method in the programmed heating is most effective to reduce heat consumption and to maintain the quality of coke.

Namely, it is an object of the present invention to conduct the control and switching of the fuel supply rate of a coke oven in the programmed heating method in a simple manner.

Such an object can be accomplished by a method of regulating fuel for a coke oven by a programmed heating method in which a change of the fuel supply rate contains at least one substantial reduction during the coal carbonization process in the coke oven, wherein the improvement comprises setting up a standard curve for the ethylene concentration or the tar concentration based on the operating conditions of the coke oven and the conditions of feed coal, measuring the ethylene concentration or the tar concentration in the coke oven gas generated in the carbonization chamber, and controlling the fuel supply rate so as to minimize the difference between the measured value and the standard value.

Now, the present invention will be described in detail with reference to the preferred embodiments.

In accompanying drawings.

DESCRIPTION OF THE PREFERRED EMBODIMENTS

During the carbonization process of coal, it is usual that at a relatively early stage of the carbonization, oxygen-containing functional groups in the coal undergo decomposition, and the coal discharges moisture and carbon dioxide first. The temperature at that time is usually about 200° C. As the temperature rises further, pyrolysis of the coal itself takes place, and a large amount of methane as well as carbon dioxide, tar, etc. will be discharged. The temperature at this stage is within a range of from 350° to 500° C. In this temperature range, the high molecular structure of the coal undergoes thermal decomposition and is converted to low molecular weight substances, whereby the mobility of the coal will be increased and the rearrangement of molecules takes place. At a temperature around 500° C., the coal undergoes re-solidification. When the temperature reaches a level of from 500° to 700° C., the thermal decomposition further proceeds, whereby mainly methane, hydrogen and carbon monoxide will be discharged and aromatic structure will gradually increase, while tar will not substantially increase. At a temperature higher than 700° C., the hydrogen content in the generated gas will increase, and the crystallization of coke further proceeds.

Figure 1:
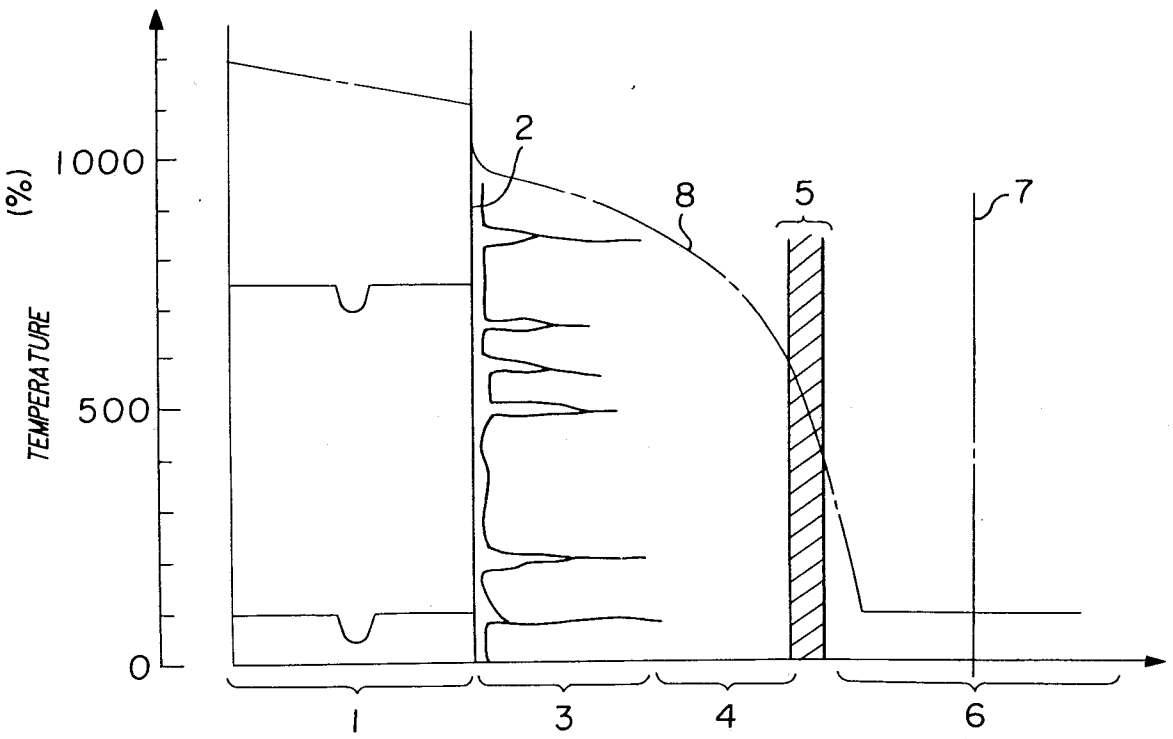
FIG. 1 is a diagram showing the carbonization process in the carbonization chamber of the coke oven.

Coke is produced by the above-mentioned carbonization process. In the coke oven, such carbonization is carried out by the heat transmitted via both sides of the walls of the carbonization chamber. Since coal has an extremely low thermal conductivity, the heat will be slowly transmitted from both of the side walls of the carbonization chamber towards the center, whereby the thermal decompositions as mentioned above take place successively. Accordingly, the smaller the moisture content of the feed coal and the higher the flue temperature of the combustion chamber, the faster the carbonization proceeds. FIG. 1 is a diagram illustrating the carbonization process. The diagram shows, from the left hand side to the right hand side, a heating wall brick 1, a clearance 2 formed between the brick and coke due to the shrinkage of coke, a coke layer 3, a semicoke layer 4, a plastic zone 5, a coal layer 6 in a non-carbonized state, and a coal center 7. The broken line 8 indicates the temperature. The coal starts to soften and melt at a temperature around 350° C., whereupon the coal particles fuse to one another while generating pyrolytic gas. As such thermal decomposition progresses from both the side walls of the carbonization chamber towards the center of the chamber, the gas generated in a temperature zone of from 350° to 500° C. (hereinafter referred to simply as a "plastic zone") and composed mainly of hydrocarbons and tar vapour, passes, in its 80–90%, through pores of red-heat coke at the oven wall side and through cracks formed by the shrinkage of the coke, undergoes secondary thermal decomposition in the red-heat coke zone to leave deposit carbon in the coke and is finally discharged out of the oven in the form of a gas composed of more volatile components.

Figure 2:
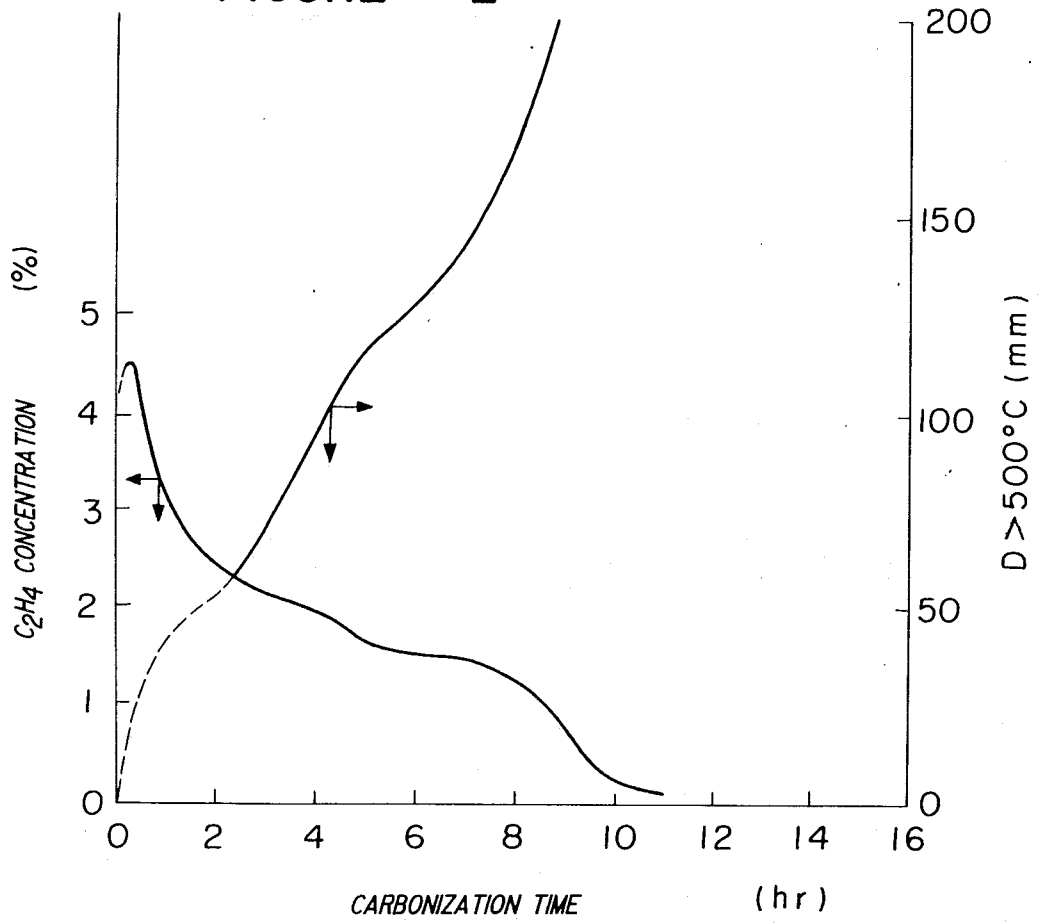
FIG. 2 is a view illustrating the changes in the ethylene concentration in the gas generated by the coke oven, and the thickness of the coke layer.
Figure 3:
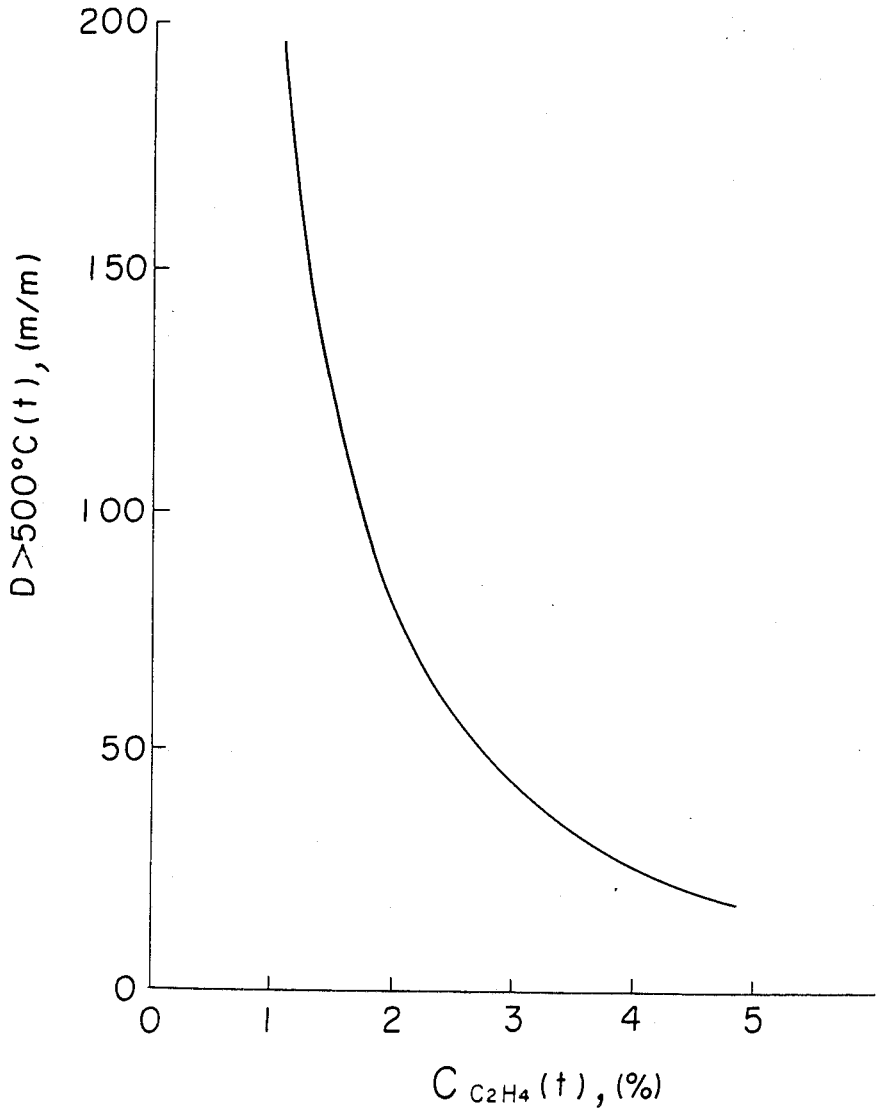
FIG. 3 is a view showing the relation between the ethylene concentration and the coke layer thickness in FIG. 2.

A particular attention has been paid to ethylene and tar as components of the generated gas. When the thermal decomposition into ethylene in the coke layer was considered, the change of the ethylene concentration with time appeared to correspond to the coking rate (which may be represented by the rate of progress of the plastic zone or the rate of expansion of the thermal decomposition zone in the coke layer). As a result of extensive studies, the following facts have been ascertained. Namely, FIG. 2 shows the change with time of the ethylene concentration in the generated gas and the change with time of the thickness, in the direction of the width of the oven, of the coke layer inclusive of a semicoke layer at a temperature of at least 500° C., when the carbonization test was conducted by a test oven ($400^W \times 600^L \times 600^H$mm) under such conditions as an oven wall temperature of 1150° C., an amount of feed coal of about 120 kg, a moisture content of the feed coal of 9% and a bulk density of the feed coal of 0.78 kg/liter (dry base). It is evident that as the coke layer at a temperature of at least 500° C. increases, the ethylene concentration gradually decreases. Further, on the basis of the results thereby obtained, the relation between the thickness of the coke layer at a temperature of at least 500° C. ($D_{>500°\,C.}(t)$) and the ethylene concentration ($C_{C_2H_4}(t)$) is shown in FIG. 3. As a result, it has been found that the relation is represented by $D_{>500°\,C.}(t)=240.2/C_{C_2H_4}(t)-35.22$, and that the coefficient of the relation is as high as 0.983. Namely, it has been confirmed that the change with time of the ethylene concentration represents directly the state of the progress of the three dimensional carbonization in the carbonization chamber.

Figure 4:
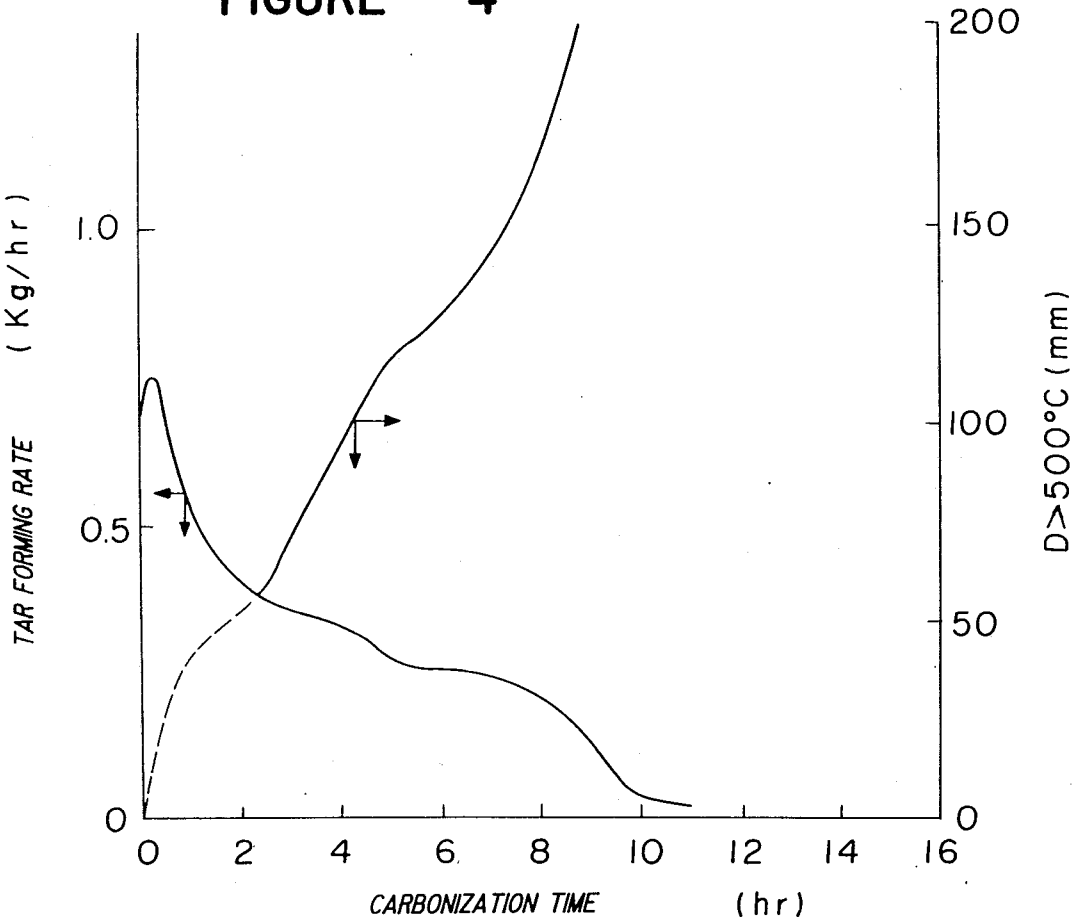
FIG. 4 is a view showing the changes in the tar concentration and the coke layer thickness.
Figure 5:
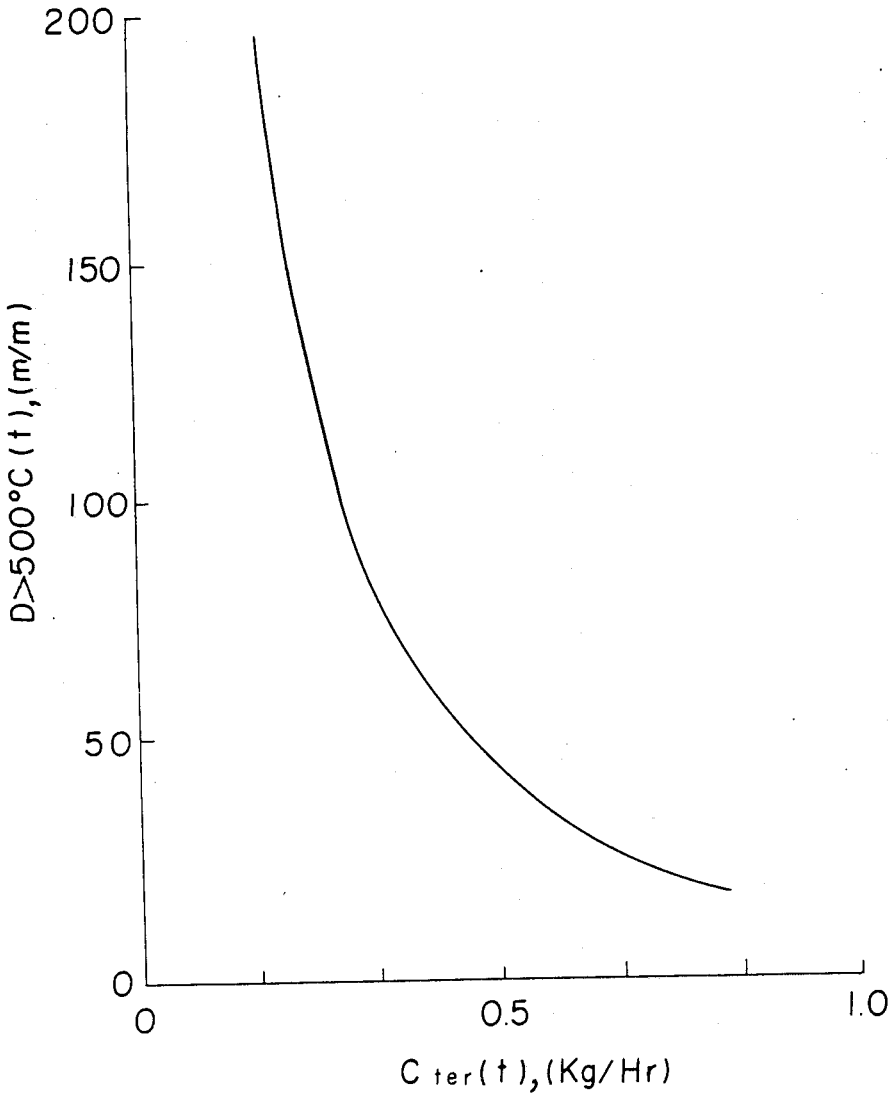
FIG. 5 is a view showing a relation between the tar concentration and the coke layer thickness in FIG. 4.

When the thermal decomposition into tar in the coke layer was considered, it appeared that the change with time of the tar concentration, as measured by a weight per unit hour, in a gas withdrawn from the generated gas at a constant withdrawing rate, corresponded to the coking rate, as in the case of the ethylene concentration. A carbonization test was conducted under the same condition as in the case of the ethylene concentration. FIG. 4 shows the change with time of the tar forming rate (kg/hr) and the change with time of the thickness, in the direction of the width of the oven, of the coke layer inclusive of a semicoke layer at a temperature of at least 500° C. It is evident that the tar forming rate decreases with the progress of the coke layer at a temperature of at least 500° C. Further, based on the results thus obtained, the relation between the thickness of the coke layer at a temperature of at least 500° C. ($D_{>500°\,C.}(t)$) and the tar forming rate ($C_{tar}(t)$) is shown in FIG. 5. As a result, it has been found that the relation is represented by $D_{>500°\,C.}(t)=40.0/C_{tar}(t)-5.9$, and that the coefficient of the relation is as high as 0.98. Namely, it has been found that, as in the case of the ethylene concentration, the change with time of the tar forming rate represents directly the state of the progress of the three dimensional carbonization in the carbonization chamber.

Figure 6:
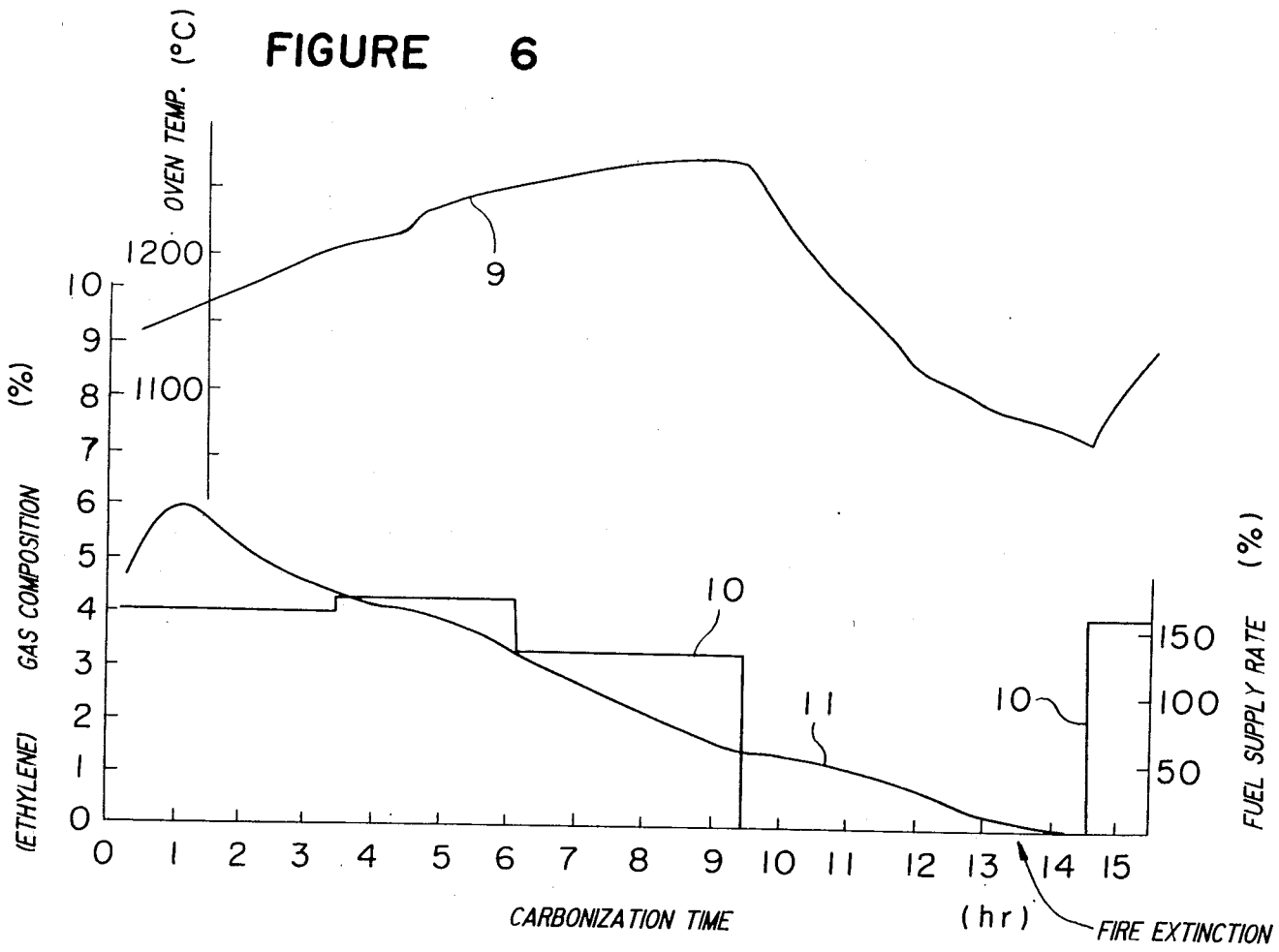
FIGS. 6 and 7 are views showing the generated ethylene concentration in the carbonization process and the change of the oven temperature with time.
Figure 7:
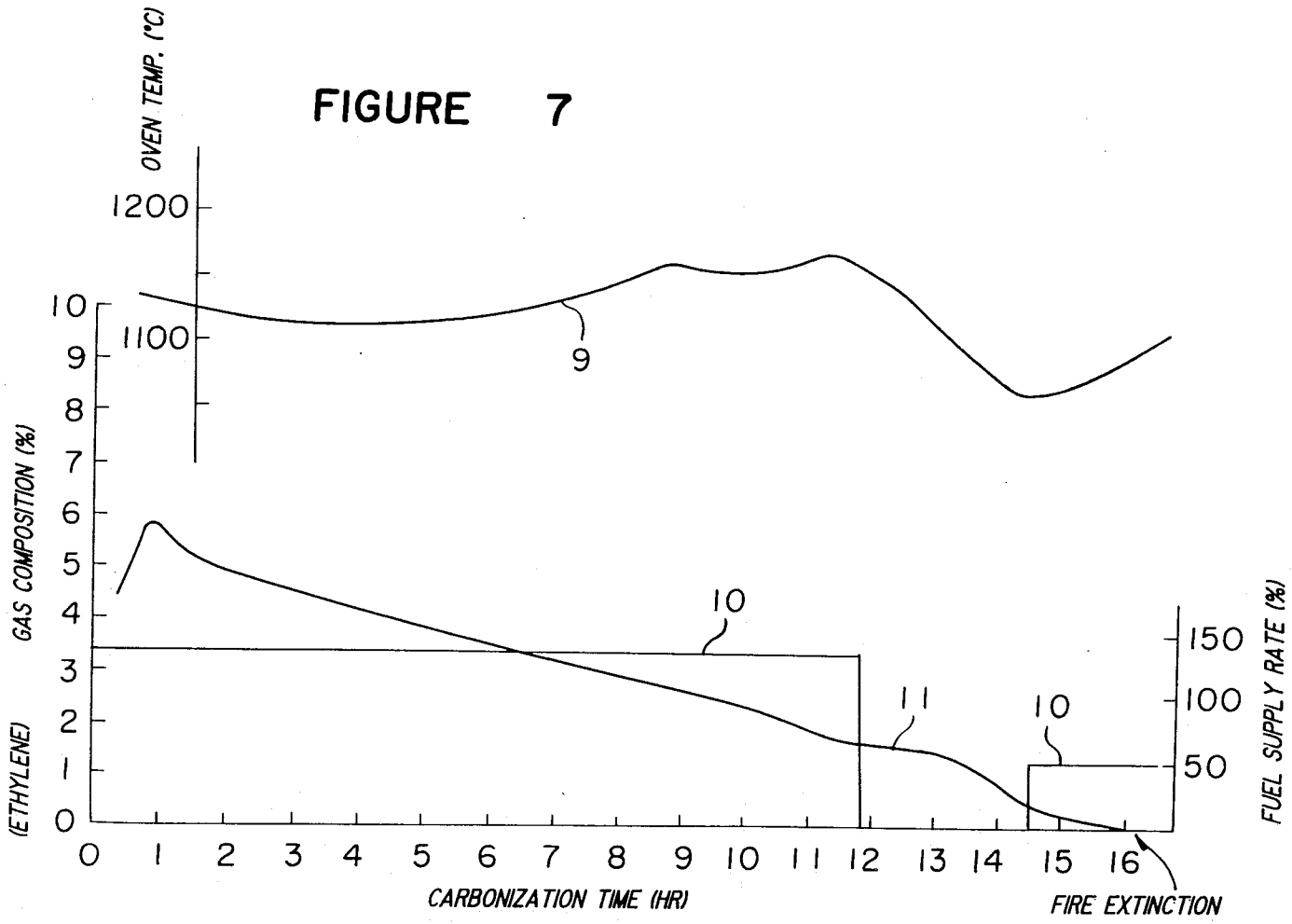

Then, on the basis of the above-mentioned results obtained by a test oven, the changes with time of the oven temperature of a practical oven and the ethylene concentration and tar concentration were measured, whereby, as shown in FIGS. 6 to 9, it has been found that the change with time of the oven temperature corresponds very well to the change with time of the ethylene concentration or the tar concentration. Namely, as shown in FIGS. 6 and 7, in the case of the ethylene concentration, the higher the level of the oven temperature 9, the greater the decreasing rate of the ethylene concentration 11, and accordingly the shorter the time for the end of the carbonization becomes. Inversely, the lower the level of the oven temperature 9, the smaller the decreasing rate of the ethylene concentration, and the longer the time for the end of the carbonization becomes.

Figure 8:
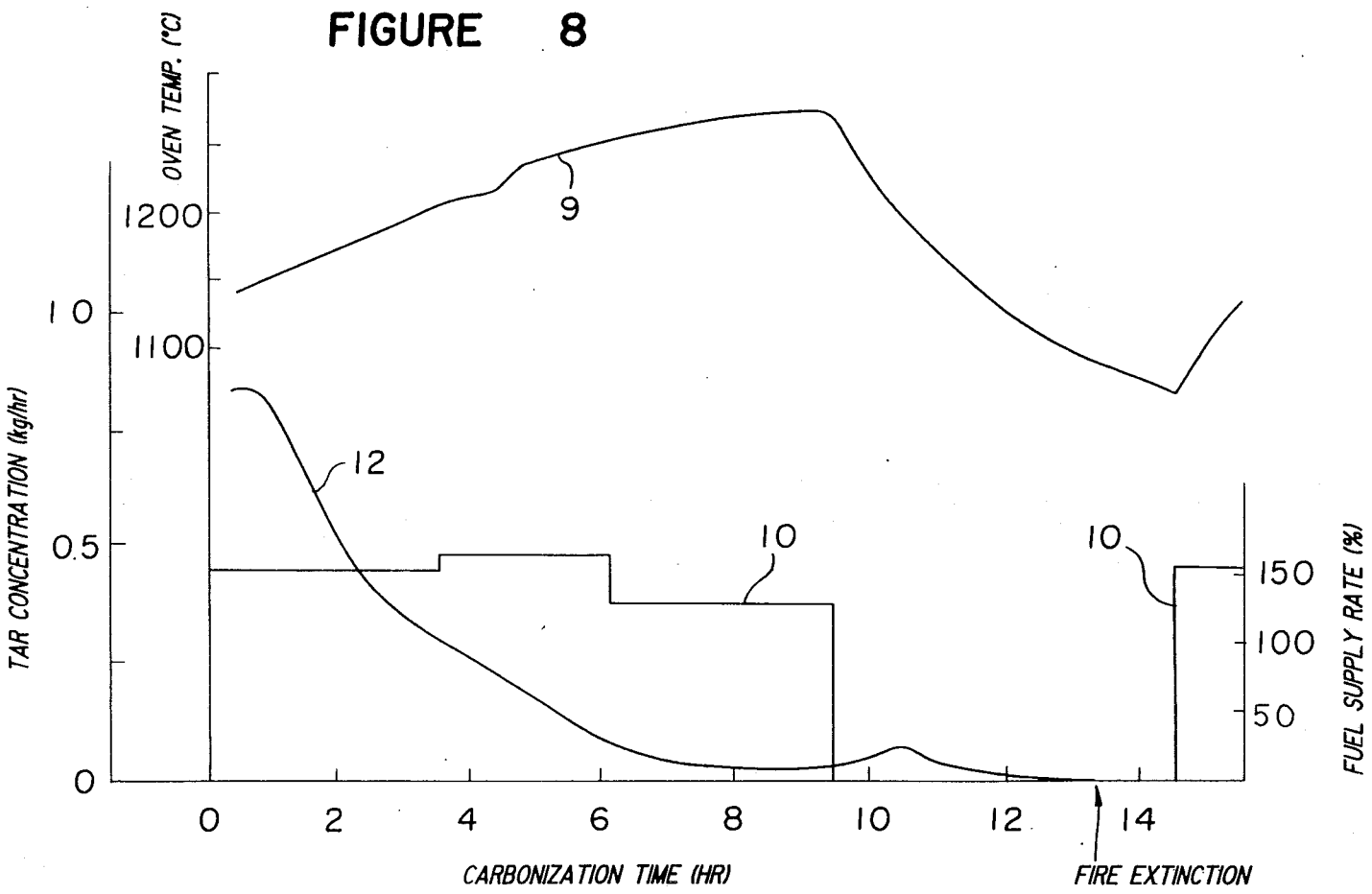
FIGS. 8 and 9 are views showing the generated tar concentration in the carbonization process and the change of the oven temperature with time.
Figure 9:
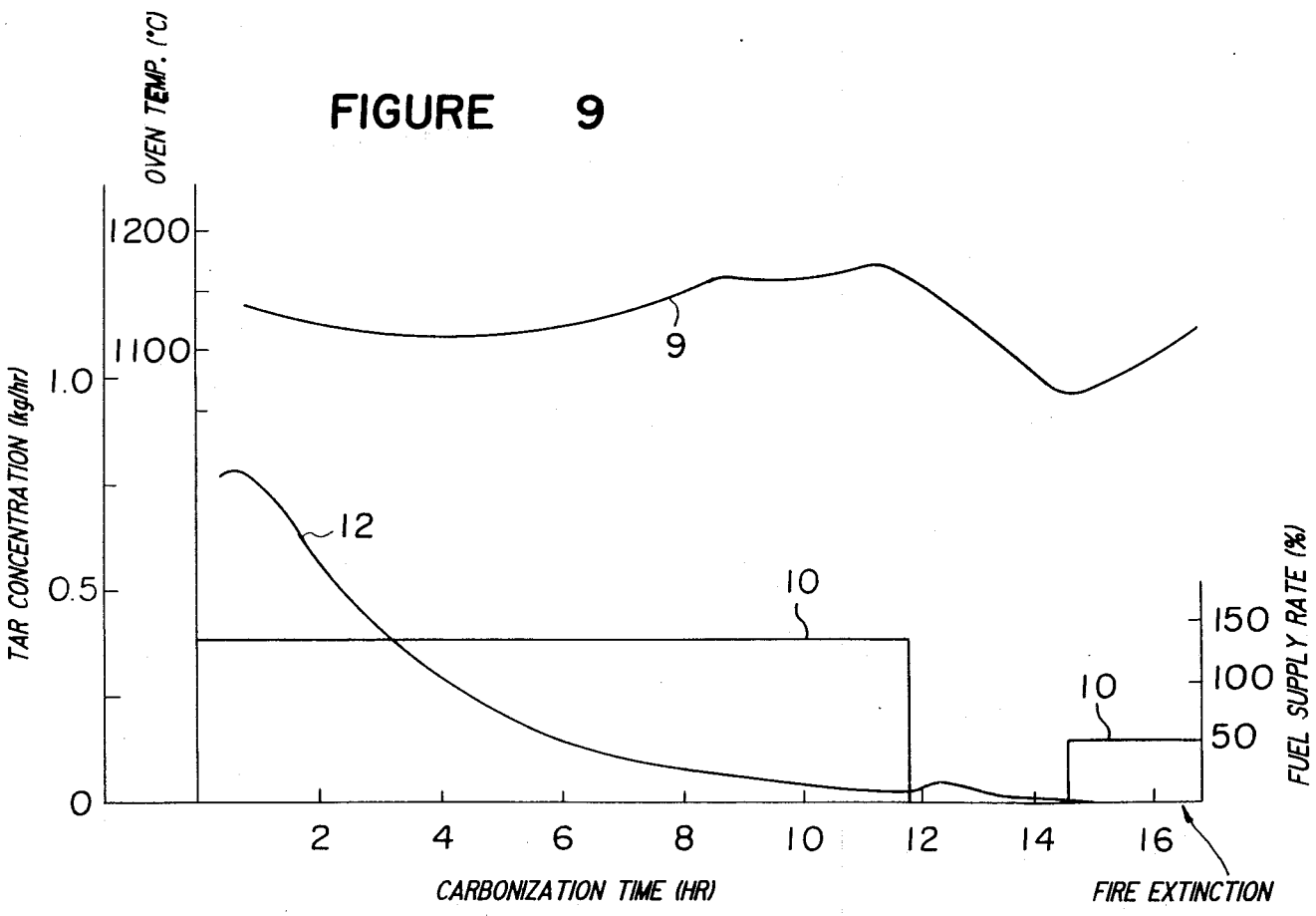

As shown in FIGS. 8 and 9, in the case of the tar concentration, it has been found that the tar concentration shows the same decreasing tendency as the tar forming rate in the case of the test oven, and the peak appears from 2 to 3 hours prior to the fire extinction. The higher the level of the oven temperature 9, the greater the decreasing rate of the tar concentration 12, and accordingly the shorter the time for the end of the carbonization becomes. Inversely, the lower the level of the oven temperature 9, the smaller the decreasing rate of the tar concentration 12, and the longer the time for the end of the carbonization becomes.

On the basis of the foregoing results, a specific method for regulating fuel for a coke oven will be described as follows. Firstly, a standard pattern for the change of the ethylene concentration or for the change of the tar concentration is set up based on the operating conditions such as the carbonization cycle, the initial oven temperature, the oven body condition, etc., and the conditions of feed coal, such as the moisture content, volatile matter, grain size and amount of coal supplied. Then, the ethylene concentration or the tar concentration in the gas actually generated from the carbonization chamber is measured. Then, the heating regulation is conducted by adjusting and controlling the fuel gas supply rate, etc., to bring the measured value to be consistent with the standard pattern. For the measurement of the ethylene concentration, various usual methods such as gas chromatography or mass spectrometry may be employed. The measurement of the tar concentration may be made by collecting the tar by a tar collecting device and quantitatively analyzing the weight change of the collected amount.

Here, the standard pattern for the ethylene concentration or the tar concentration is set up based on the result of the statistical analysis of numerous experimental data. The statistical analysis is made by classifying the experimental data and approximating several groups of conditions to standard conditions. Alternatively, such a standard pattern may be set up by simulation by means of a computer. In such a case, there will be required data on the thermal properties (i.e. the specific heat and heat conductivity) and the density change of the feed coal, the feed coal temperature, the water content, the volatile matter, the grain size of the coal as well as the oven temperature pattern as a function of time, as the carbonization condition, and the oven dimensions (i.e. the oven width, the oven height and the oven length) and the thickness and thermal properties of the heat conductive wall brick, as the oven body conditions. On the other hand, there will be required as parameters for the reaction rate of the carbonization of coal, factors such as the reaction rate constants, the factors of frequency, the activated energy, etc. which correspond to the respective reaction formulas.

Now, a specific example of a simulation model will be described. Firstly, the reaction model is based on the Krevelen model with an addition of the thermal decomposition reaction of tar in the coke layer in the carbonization chamber, as shown below.

$$\text{Coal} \xrightarrow{K_1} \text{Plastic zone} \quad (1)$$

$$\text{Plastic zone} \xrightarrow{K_2} \text{Semicoke} + \text{Gas-1} + \text{Tar} \quad (2)$$

$$\text{Semicoke} \xrightarrow{K_3} \text{Coke} + \text{Gas-2} \quad (3)$$

$$\text{(Tar)hot} \xrightarrow{K_4} \text{Deposited Semicoke} + \text{Gas-1} \quad (4)$$

$$\text{Deposited Semicoke} \xrightarrow{K_5} \text{Deposited Coke} + \text{Gas-2} \quad (5)$$

$$\text{(Tar)cold} \xrightarrow{K_2} \text{(Tar)hot} \quad (6)$$

Figure 10:
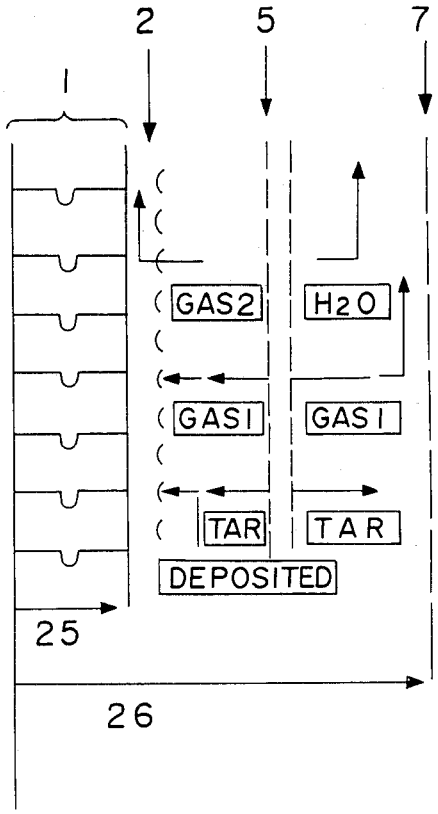
FIG. 10 is a simulated view of a carbonization chamber.

The model is one dimensional in the direction of the oven width. The model is illustrated in FIG. 10.

The basic thermal decomposition reactions of the coal are represented by reactions (1) to (3), whereby the moisture is assumed to escape from the coal center side, the oven wall side of the plastic zone is regarded as the hot side, and the coal center side of the plastic zone is regarded as the cold side. The gas and tar reached the hot side pass through the spaces in the coke layer and are discharged out of the oven. During this step, the tar undergoes partial thermal decomposition as shown by the reaction formulas (4) and (5), whereby it deposits on the coke layer.

The tar reaching the cold side, condenses, and then evaporates in accordance with the formula (6) when the temperature at that position reaches a melting temperature level and joins the tar transferring to the hot side The basic equation are an equation (7) for the heat transmission and an equation (8) for the mass balance based on the above reactions.

$$\frac{\partial T_B}{\partial t} = \frac{\partial}{\partial x}\left(\frac{\lambda_B}{\rho_B Cp_B}\frac{\partial T_B}{\partial x}\right) \text{ (for the brick)} \quad (7)$$

$$\frac{\partial T}{\partial t} = \frac{\partial}{\partial x}\left(\frac{\lambda}{\rho Cp}\frac{\partial T}{\partial x}\right) + \frac{1}{\rho Cp}\sum_{i=1}^{12} FiCpiT + \frac{1}{\rho Cp}\sum_{j=1}^{5} qj$$

(for the interior of the carbonization chamber)

where

-continued $$\rho = \sum_{i=1}^{7} \rho i = \sum_{i=1}^{7} MiCi \text{ (density)}$$

$$Cp = \frac{\sum_{i=1}^{7} \rho iCpi}{\sum_{i=1}^{7} \rho i} = f_1(T) \text{ (specific heat)}$$

$$\lambda = \frac{\sum_{i=1}^{7} \rho i\lambda i}{\sum_{i=1}^{7} \rho i} = f_2(T) \text{ (heat conductivity)}$$

Mi: Molecular weight
qj: Reaction heat of the j-reaction
Fi: Transfer speed of the i-componment
i:
1: Moisture content
2: Coal
3: Plastic layer
4: Semicoke
5: Coke
6: Deposited semicoke
7: Deposited coke
8: (Gas-1)hot side
9: (Gas-1)cold side
10: Gas-2
11: (Tar)hot side
12: (Tar)cold side $F^T = (0,0,0,0,0,0,0,F_1,0,F_2,F_3,0)$ $$\frac{\partial \underline{C}}{\partial t} = \underline{\underline{R}}\,\underline{C} + \frac{\partial F}{\partial x} \quad (8)$$

$\underline{C}^T = (C_1, C_2, C_3, C_4, C_5, \ldots, C_{12})$ $$R = \begin{bmatrix} 0,0,0,0,0,0,0,0,0,0,0,0 \\ 0,-K_1,0,0,0,0,0,0,0,0,0,0 \\ 0,K_1,-K_2,0,0,0,0,0,0,0,0,0 \\ 0,0,K_2,-K_3,0,0,0,0,0,0,0,0 \\ 0,0,0,K_3,0,0,0,0,0,0,0,0 \\ 0,0,0,0,0,-K_5,0,0,0,0,K_4,0 \\ 0,0,0,0,0,K_5,0,0,0,0,0,0 \\ 0,0,K_2,0,0,0,0,0,0,0,K_4,0 \\ 0,0,K_2,0,0,0,0,0,0,0,0,0 \\ 0,0,0,K_3,0,K_5,0,0,0,0,0,0 \\ 0,0,K_2,0,0,0,0,0,0,0,-K_4,K_2 \\ 0,0,K_2,0,0,0,0,0,0,0,0,-K_2 \end{bmatrix}$$

Ki is a reaction rate constant and is represented by $$Ki = Ki_0 \operatorname{Exp}\left(-\frac{E}{RT}\right).$$

As the boundary conditions, there will be given the conditions of the heating wall on the flue side and the conditions at the coal center.

$x=0$: $T_B(0,t)=g(t)$ is given.

$$x = W_1: -\lambda_B \frac{\partial T_B}{\partial x} = 4.88\,\epsilon\left[\left(\frac{T_B+273}{100}\right)^4 - \left(\frac{T+273}{100}\right)^4\right] \quad (9)$$

$$x = W_2: \frac{\partial T}{\partial x} = 0$$

The intial conditions are given as follows:

$$T_B(x,0)=T_{B0}$$

$$T(x,0)=T_0 \quad (10)$$

$$\underline{C}^T(x,0)=(C_{10}, C_{20}, 0,0 \ldots, 0)$$

A curve of the change with time of the tar concentration obtained by solving the above-mentioned equations (7) and (8) under the above conditions with respect to each time step by a finite differential method, is taken as the standard pattern.

Further, a standard pattern for the change with time of the ethylene concentration may be prepared by converting the curve of the change with time of the tar concentration thus obtained.

Figure 11:
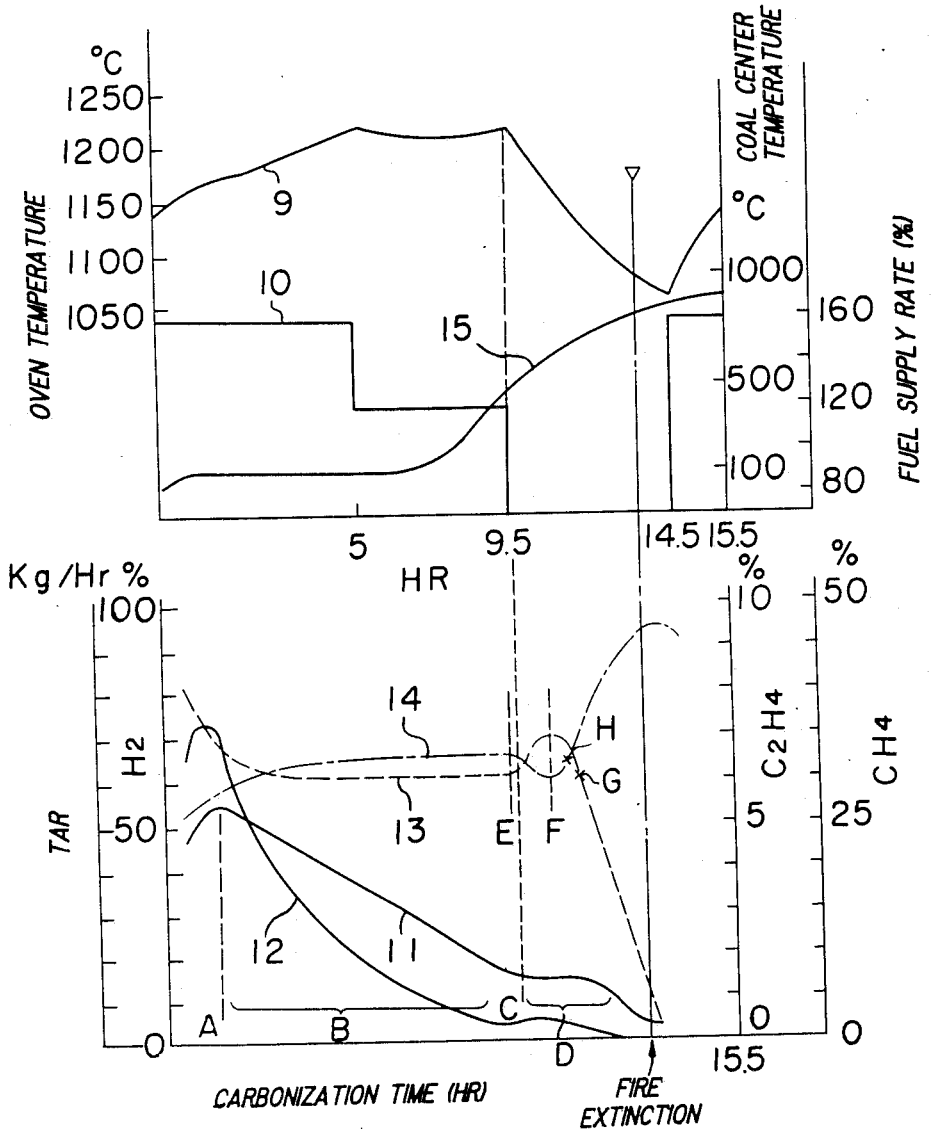
FIG. 11 is graphs showing changes of the concentrations of ethylene, methane, hydrogen and tar in the coke oven gas and the coal center temperature.

According to the present invention, a standard pattern for the change with time of the ethylene concentration or the tar concentration is set up, while the ethylene concentration or the tar concentration in the coke oven gas generated in the carbonization chamber is actually measured, and the fuel supply rate is controlled to minimize the difference between the measured value and the standard value. Further, by so controlling the fuel supply rate based on the change with time of the component in the coke oven gas, it is also possible to accurately determine the timing for the switching of the fuel supply rate, i.e. for the substantial reduction of the fuel supply rate from a large flow rate at the initial stage of the carbonization to a small flow rate inclusive of a zero rate. Namely, there is a close relationship between the coal center temperature and the change with time of the ethylene concentration, the tar concentration, the methane concentration or the hydrogen concentration in the coke oven gas during the intermediate stage of the carbonization process of coal. FIG. 11 shows a typical example illustrating the results of the measurement of the ethylene concentration 11 in a gas generated in a practical coke oven and the coal center temperature 15, in which the abscissa represents the carbonization time (hr), and the ordinate represents the ethylene concentration, the oven temperature, the fuel gas supply rate and the coal center temperature. It is evident from FIG. 11, the timing where the coal center temperature 15 reaches a level around 500° C. very well coincides with the timing when the changing rate of the ethylene concentration 11 abruptly decreases. Further, as in the case of the ethylene concentration, in the case of the tar concentration, the timing when the coal center temperature 15 reaches a level around 500° C. very well coincides the timing when the changing rate of the tar concentration 12 turns from substantial zero to plus. Furthermore, it has been found that also in the cases of the methane concentration 13 and the hydrogen concentration 14, the timing when the coal center temperature 15 reaches a level around 500° C., very well coincides with the timing where the changing rates of the respective concentrations abruptly increase.

On the basis of the above studies, there will be described specific manners for determining the timing for the substantial reduction of the fuel supply rate, based on the change in the concentration of each component of the gas generated during the carbonization.

In the programmed heating method employed in the present invention, the fuel supply at the initial stage of the carbonization of coal is set to be a large flow rate in order to rapidly raise the temperature of the coal filled in the carbonization chamber, and the large flow rate is preferably at least about 1.2 times the fuel supply rate of a regular heating method. The greater the supply rate, the better. However, the supply rate should be restricted within a range where no substantial adverse effects to the coke oven structure such as the refractory bricks will be brought about by the high temperature or local heating. Practically, this large flow rate is determined depending upon the structure of the oven or the combustion system employed, but it is selected usually within a range of from 1.2 to 3 times, preferably from 1.3 to 2.3 times, the supply rate of a usual regular heating method. Of course, this flow rate may not necessarily be constant. For instance, if the calorie of the fuel gas varies, the variation may be compensated by adjusting the flow rate.

The small flow rate inclusive of a zero rate is meant for a fuel supply rate within a range from about 0.3 time the supply rate of a regular heating method to the complete termination of the fuel supply.

The term "substantial reduction of the fuel supply rate" used in this specification, is meant for the reduction of the fuel supply rate from the above-defined large flow rate to the above-defined small flow rate.

It is important to determine the timing for the substantial reduction of the fuel supply rate to the small flow rate inclusive of a zero rate by the indicator of at least one of the above-mentioned ethylene concentration, tar concentration, methane concentration or hydrogen concentration.

For the determination of the timing for the substantial reduction of the fuel supply rate, firstly it is necessary to analyze the composition of the gas generated in the carbonization chamber as the carbonization proceeds, and thereby to obtain data on the concentration change, as the time of the carbonization passes, of a component to be used as the indicator. If the ethylene concentration is used as the indicator, the substantial reduction of the fuel supply rate is carried out when the ethylene concentration reaches a level of from 0.8 to 2% by volume (preferably to a level close to 2% by volume when the operation ratio of the coke oven is high, and to a level close to 0.8% by volume when the operation ratio is low) during the latter half of the carbonization, or when the decreasing rate of the ethylene concentration decreases by at least 10% relative to a substantially constant rate (preferably when a relatively large rate decrease, e.g. by at least 20%, is observed in the case where the operation ratio of the coke oven is high, and when a relatively small rate decrease near to 10% is observed in the case where the operation ratio is low) i.e. in the D-zone in FIG. 11. Point C corresponds roughly to a point where the decreasing rate of the ethylene concentration has decreased to a level of 0.3% by volume/hr or less. Likewise, the D-zone corresponds roughly to a period of within 2 hours, preferably within 1 hour, from the time when the decreasing rate of the ethylene concentration decreased by at least 10%. It is of course possible to determine the timing for the substantial reduction of the fuel supply rate by a certain statistical amount obtained by treating the change of the ethylene concentration statistically, instead of using the above-mentioned decreasing rate of the ethylene concentration.

Now, the use of the tar concentration as the indicator will be described. The substantial reduction of the fuel supply rate is carried out during a period of 2 hours from the time when the changing rate of the tar concentration reaches substantially zero during the latter half of the carbonization.

As shown in FIG. 11, the change of the tar concentration increases at the initial stage of the carbonization, and the increasing rate becomes zero in a relatively short period of time (point A in FIG. 11). Then, the tar concentration continues to decrease quadratically (B-zone in FIG. 11). As the time passes further, the decreasing rate of the tar concentration reaches substantially zero (point C in FIG. 11) and then the tar concentration starts to increase a little (D-zone in FIG. 11). In the present invention, it is important that the substantial reduction of the fuel supply rate is carried out at point C or in the D-zone in FIG. 11. Point C corresponds roughly to a point where the decreasing rate of the tar concentration becomes to be 5% or less. It is of course possible to determine the timing for the substantial reduction of the fuel supply rate by a statistical amount obtained by treating the change of the tar concentration statistically, instead of using the changing rate of the tar concentration.

Now, the use of the methane concentration as the indicator will be described. Referring to the data on the change of the methane concentration obtained in the above-mentioned manner, the substantial reduction of the fuel supply rate is conducted within the range from the first point (point E in FIG. 11) to a second point (point G in FIG. 11). Namely, as shown in FIG. 11, the methane concentration gradually decreases and the changing rate of the concentration reaches the first point of the time (point E in FIG. 11) when the decreasing rate reaches a level of 0.1% by volume/hr or less (preferably when the decreasing rate is close to 0.1% by volume/hr in the case where the operation ratio of the coke oven is high, and when the decreasing rate is close to zero in the case where the operation ratio is low). Then, the methane concentration begins to increase and the increasing rate again reaches zero (point F in FIG. 11). The concentration again starts to decrease rapidly through the second point of the time (point G in FIG. 11) when the methane concentration becomes equal to the concentration of the first point of the time (point E in FIG. 11). From the viewpoint of experience, the substantial reduction of the fuel supply rate may be carried out within 2 hours, preferably within 1 hour, from the time when the reducing rate of the methane concentration reaches a level of 0.1% by volume/hr or less. It is of course possible to use a certain statistical amount obtained by treating the change of the methane concentration statistically, instead of using the changing rate of the methane concentration.

Further, in the case where the hydrogen concentration is used as the indicator, the substantial reduction of the fuel supply rate is carried out within a range from the first point of time (point E in FIG. 11) to a second point of the time (point H in FIG. 11). Namely, as shown in FIG. 11, the change of the hydrogen concentration increases gradually and reaches the first point of the time (point E in FIG. 11) when the increasing rate of the hydrogen concentration reaches zero during the latter half of the carbonization. Then, the hydrogen concentration decreases and the changing rate of the concentration again reaches zero (point F in FIG. 11). The hydrogen concentration again begins to increase through the second point of time (point H in FIG. 11) when the hydrogen conentration becomes equal to the concentration at the first point of time (point E in FIG. 11). From the viewpoint of experience, the substantial reduction of the fuel supply rate may be conducted within 2 hours, preferably within 1 hour, from the first point of time (point E in FIG. 11) when the increasing rate of the hydrogen concentration reaches zero. It is of course possible to use a certain statistic amount obtained by treating the change of the hydrogen concentration statistically, instead of using the changing rate of the hydrogen concentration.

It is preferred to use a plurality of the concentrations of the components of the coal oven gas as the indicators for the substantial reduction of the fuel supply rate, whereby the timing for the substantial reduction of the fuel supply rate can accurately be determined. It is particularly preferred to determine the timing for the substantial reduction of the fuel supply rate based on at least two concentrations out of the ethylene concentration, the methane concentration and the hydrogen concentration.

In the present invention, the control of the fuel supply rate based on the ethylene concentration or the tar concentration is meant for adjustment of the fuel supply rate in a small degree to bring each concentration to its standard pattern. Whereas, the switching of the fuel supply rate is meant, as mentioned above, the substantial reduction of the fuel supply rate (usually to a level of not higher than 0.3 time the supply rate in the case of a regular heating method) from the large flow rate to the small flow rate inclusive of a zero rate.

As described in detail in the foregoing, according to the present invention, the control of the fuel supply rate is conducted so that the ethylene concentration or the tar concentration in the gas generated in the carbonization chamber, coincides with the standard pattern, whereby the state of progress of the carbonization can readily be regulated. Further, the determination of the timing for the substantial reduction of the fuel supply rate can accurately and readily be made by controlling the fuel supply rate, based on the change with time of the concentration of each component in such generated gas. As will be evident from the example given hereinafter, it is thereby possible to reduce the fuel consumption substantially and to obtain coke having good quality. Thus, the present invention is very effective as a method for regulating fuel by a programmed heating method.

Now, the present invention will be described in further detail with reference to Examples. However, it should be understood that the present invention is by no means restricted by these specific Examples.

For the purpose of the present invention, the operation ratio x of the coke oven is defined by the formula:

$$x = \frac{24(\text{hr})}{\text{Total carbonization time (hr)}} \times 100\ (\%)$$

A operation ratio of not higher than 140% is referred to as "a low operation ratio", and a operation ratio higher than 140% is referred to as "a high operation ratio".

Figure 12:
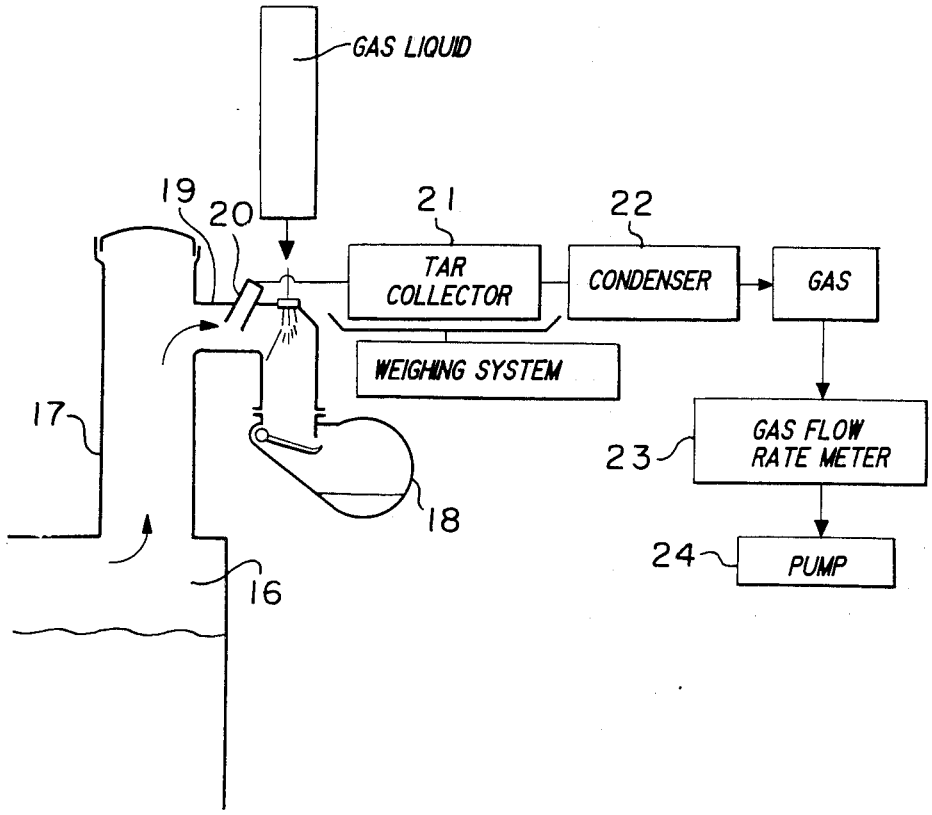
FIG. 12 is a view illustrating the method for measuring the tar concentration.

The concentrations of ethylene, methane and hydrogen may be measured by commonly employed methods such as gas chromatography or mass spectrometry. The concentration of tar may be measured by a method wherein the weight change of a tar collector upon collection of tar is utilized. For instance, as shown in FIG. 12, the gas generated in the carbonization chamber 16 is sucked at a constant rate by a pump 24, from a sampling probe 20 provided in a vent portion 19 between an up-rising tube 17 and a collecting main 18, via a tar collector 21 packed with e.g. dried glass wool and maintained at a constant temperature of from 100° to 120° C., a condenser 22 and a gas flow rate meter 23, whereby the weight change of the tar collector 21 is measured.

The physical property values given in these Examples were measured by the following methods.

(1) Characteristics of the feed coal
- Ash content (Ash): JIS M 8812
- Volatile matter (VM): JIS M 8812
- Gieseler fluidity (FI): JIS M 8801
- Average reflectance ($\overline{R}o$): JIS M 8816
- Total sulfur content (Sul): JIS M 8813
- Total inert (TI): JIS M 8816

(2) Coke strength after reaction (CSR)
- Sample grain size: 20 mm+1 mm
- Sample weight: 200 g/time
- Gas composition: $CO_2$ (100%)
- Gas flow rate: 5 Nl/min.
- Reaction temperature: 1100° C.
- Reaction time: 120 minutes
- Strength: % by weight of the grains remaining on a sieve of 10 mm after 600 rotations (20 rpm×30 min.) in an I-type drum (3) Cold drum strength ($DI_{15}^{30}$)
- JIS K 2151

EXAMPLE 1

A blended coal having such characteristics as shown in Table 1 was fed into a carbonization chamber having a width of 400 mm and a length of 12.8 m, and coke oven gas was used as fuel. Carbonization was conducted in accordance with a standard pattern of the ethylene concentration as shown in FIG. 13, which was set up based on the operating conditions of the coke oven and the conditions of the feed coal.

Figure 13:
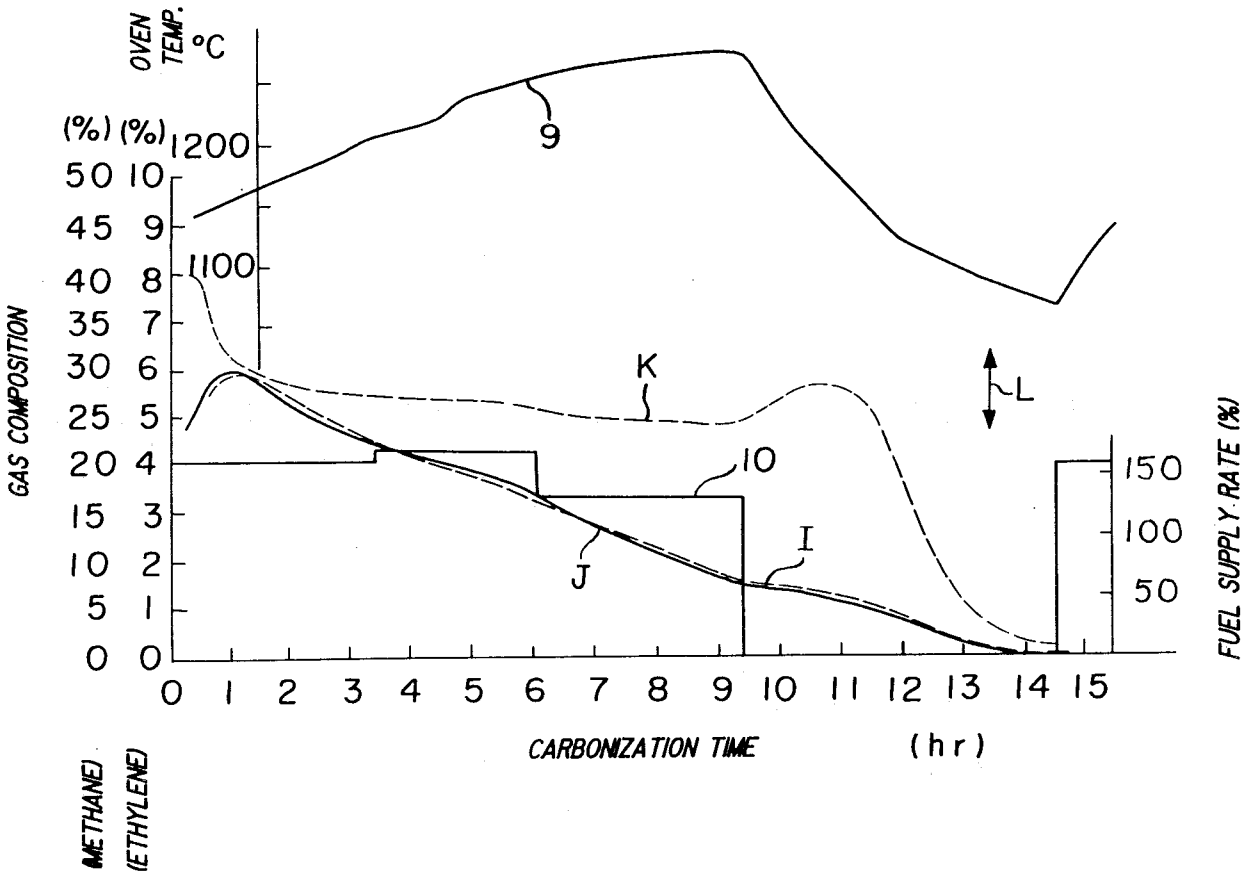
FIGS. 13 and 14 are graphs showing the changes of the concentrations of ethylene, methane and hydrogen, and the fuel gas supply rate in the Examples.

In FIG. 13, abscissa represents the carbonization time (hr) and the ordinate represents the ethylene concentration, the methane concentration and the gas supply rate. Dotted line I is the standard curve for the ethylene concentration, and solid line J represents measured values of the ethylene concentration. Namely, solid line J represents the results obtained by controlling the fuel supply rate to bring the ethylene concentration to be consistent with dotted line I. Broken line K represents the measured values of the methane concentration, and solid line 10 represents the fuel supply rate.

Firstly, in order to regulate the progress of the carbonization, the fuel supply rate was controlled to bring the ethylene concentration in line with the standard curve shown by dotted line I, and the switching of the fuel supply rate (the supply rate was brought to zero) was carried out when the ethylene concentration reached 1.45% by volume, the decreasing rate of the ethylene concentration was 0.2% by volume/hr, the methane concentration was 24.3% by volume, and the increasing rate of the methane concentration after the methane concentration once decreased to zero, became 3.3% by volume/hr.

Then, the end of the carbonization was confirmed after 13.5 hours from the initiation of the carbonization. After 1.1 hours from the end of the carbonization, the fuel supply rate was switched from 0 to 160%, and after 2.0 hours from the end of the carbonization, coke was discharged. The average grain size, the cold drum strength and the strength after reaction of the coke thereby obtained were measured. The results are shown in Table 2.

TABLE 1

| Ash (%) | VM (%) | Sul (%) | Fi (log ddpm) | Ro | TI (%) |
|---|---|---|---|---|---|
| 8.75 | 26.85 | 0.60 | 1.91 | 1.14 | 27.4 |

TABLE 2

| Operation ratio (%) | Reduction rate of fuel consumption (%) | Quality of coke | | |
|---|---|---|---|---|
| | | Cold drum strength ($DI_{15}^{30}$) | Coke strength after reaction (CSR) | Average grain size (mm) |
| 155 | 10 | 92.8 | 62.8 | 53.4 |

EXAMPLE 2

A blended coal having such characteristics as shown in Table 1 was fed into a carbonization chamber having a width of 400 mm and a length of 12.8 m, and coke oven gas was used as fuel. Carbonization was conducted in accordance with a standard pattern of the ethylene concentration as shown in FIG. 14, which was set up based on the operating conditions of the coke oven and the conditions of the feed coal.

Figure 14:
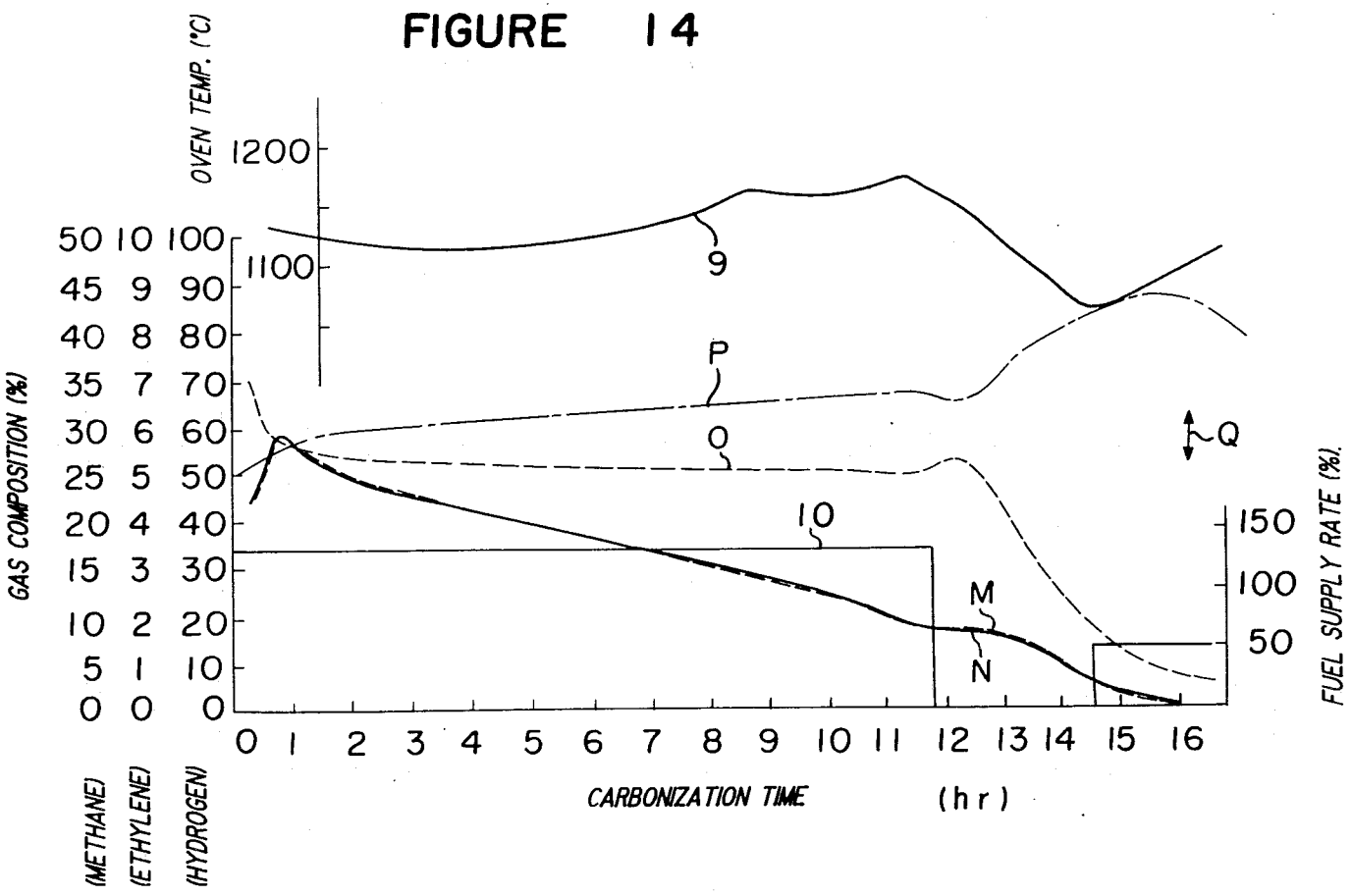

In FIG. 14, abscissa represents the carbonization time (hr) and the ordinate represents the ethylene concentration, the methane concentration, the hydrogen concentration and the gas supply rate. Dotted line M is the standard curve for the ethylene concentration, solid line N represents measured values of the ethylene concentration, broken line O is the methane concentration, and dotted broken line P represents measured values of the hydrogen concentration. Solid line 10 represents the fuel supply rate.

Firstly, in order to regulate the progress of the carbonization, the fuel supply rate was controlled to bring the ethylene concentration in line with the standard curve shown by dotted line M, and the switching of the fuel supply rate (the supply rate was brought to zero) was carried out when the methane concentration reached 25.0% by volume, the increasing rate of the methane concentration after the methane concentration once decreased to zero, became 2.9% by volume/hr, the hydrogen concentration reached 66.0% by volume, and the decreasing rate of the hydrogen concentration became 3.5% by volume/hr.

Then, the end of the carbonization Q was confirmed after 16.2 hours from the initiation of the carbonization.

In order to maintain the oven temperature, the fuel supply rate was switched from zero to 50% after 14.5 hours from the initiation of the carbonization (i.e. 1.6 hours before the fire extinction). After 20 hours from the end of the carbonization, coke was discharged. The average grain size, the cold drum strength and the strength after reaction of the coke thereby obtained were measured. The results are shown in Table 3.

TABLE 3

| Operation ratio (%) | Reduction rate of fuel consumption (%) | Quality of coke | | |
|---|---|---|---|---|
| | | Cold drum strength ($DI_{15}^{30}$) | Coke strength after reaction (CSR) | Average grain size (mm) |
| 135 | 8 | 92.7 | 60.8 | 55.6 |

We claim:

1. In a method of regulating fuel supply rate in the coking of coal in a coke oven, which generates coke oven gas including ethylene, tar, hydrogen and methane, by a programmed heating technique in which there is at least one period in which there is a substantial reduction in the rate of fuel supplied during the coking process, the improvement wherein the programmed heating technique comprises:

(A) initially preparing a standard curve for the change with time of the ethylene concentration or the tar concentration in the gas discharged during the coking of a given coal in a coke oven, based on a statistical analysis of experimental data obtained from operating conditions of the coke oven and conditions of the feed coal;

(B) coking a batch of said given coal in said oven heated by combustion of a supply of fuel and continuously measuring the ethylene concentration or the tar concentration in the coke oven gas generated during the coking step; and (C) controlling the fuel supply rate during step (B) by reference to the standard curve prepared in step (A) so that the difference between the ethylene concentration or the tar concentration continuously determined in step (B) and the ethylene concentration or the tar concentration exhibited by said standard curve is constantly minimized, thereby achieving an economical regulation of the fuel supply rate.

2. The method of regulating fuel supply rate for a coke oven according to claim 1, wherein the operating conditions of the coke oven are cabonization cycle, initial oven temperature and oven body condition.

3. The method of regulating fuel supply rate for a coke oven according to claim 1, wherein the conditions of feed coal are moisture content, volatile matter content, grain size and amount of coal supplied.

4. The method of regulating fuel supply rate for a coke oven according to claim 1, wherein, during the coking process of step (B), the time of said period during which the rate of fuel supply is substantially reduced from a large flow rate during the initial stage of coking to a small flow rate, which reduced flow includes a zero rate of supply of fuel, is determined on the basis of a change in concentration of the ethylene component, the tar component, the hydrogen component, the methane component, or combinations thereof as the concentrations of these components are continuously determined in the coke oven gas generated during coking step (B).

5. The method of regulating fuel supply rate for a coke oven according to claim 4, wherein the substantial reduction of the fuel supply rate is conducted at the time when the ethylene concentration reaches a level of 0.8 to 2% by volume.

6. The method of regulating fuel supply rate for a coke oven according to claim 4, wherein the substantial reduction of the fuel supply rate is conducted within 2 hours after the changing rate of the tar concentration becomes substantially 0.

7. The method of regulating fuel supply rate for a coke oven according to claim 4, wherein the substantial reduction of the fuel supply rate is conducted within 2 hours after the changing rate of the hydrogen concentration becomes substantially 0.

8. The method of regulating fuel supply rate for a coke oven according to claim 4, wherein the substantial reduction of the fuel supply rate is conducted within 2 hours after the reduction rate of the methane concentration reaches to a level of not higher than 0.1% by volume/hr.

9. The method of regulating fuel supply rate for a coke oven according to claim 4, wherein the substantial reduction of the fuel supply rate is timed on the basis of changes in the concentrations of at least two components which are the ethylene, hydrogen and methane components in the gas generated in the carbonization chamber.

* * * * *